US007552970B2

(12) United States Patent
LaPointe

(10) Patent No.: US 7,552,970 B2
(45) Date of Patent: Jun. 30, 2009

(54) FURNITURE MECHANISM WITH TILT CAM FOR MULTIPLE POSITION TILT

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 426 days.

(21) Appl. No.: 11/484,444

(22) Filed: Jul. 11, 2006

(65) Prior Publication Data

US 2008/0012394 A1 Jan. 17, 2008

(51) Int. Cl.
*A47C 3/03* (2006.01)

(52) U.S. Cl. ..... 297/271.4; 297/68; 297/83; 297/261.4

(58) Field of Classification Search ..... 297/68, 297/83, 271.1, 271.4, 271.3, 86, 90, 261.1, 297/261.4
See application file for complete search history.

(56) References Cited

U.S. PATENT DOCUMENTS 3,287,059 A * 11/1966 Rosmarin ..... 297/271.4
3,475,051 A * 10/1969 Crawford ..... 297/271.4
3,802,735 A * 4/1974 Re ..... 297/271.4
4,154,475 A * 5/1979 Shoemaker et al. ..... 297/83 X
4,212,495 A * 7/1980 Gall ..... 297/271.4

* cited by examiner

*Primary Examiner*—Anthony D Barfield
(74) *Attorney, Agent, or Firm*—Harness, Dickey & Pierce, P.L.C.

(57) ABSTRACT

A furniture mechanism includes first and second side plates. First and second support members are rotatably pinned to the side plates. First and second pantograph linkage sets are each linked to one of the side plates and each extend from a stowed position to a fully extended position and support a user leg rest. A base frame includes first and second side channels. A U-shaped leaf spring interconnected to the first and second side channels and connected to the support members permits co-rotation of at least the connection plates, the pantograph linkage sets, and the support members with respect to the base frame. First and second tilt cams are rotatably fastened to the support members. The tilt cams each include multiple cam faces which define a plurality of temporary detent positions of the mechanism by contact of individual cam faces with the side channels.

15 Claims, 14 Drawing Sheets

FURNITURE MECHANISM WITH TILT CAM FOR MULTIPLE POSITION TILT

FIELD

The present disclosure relates to furniture member operating mechanisms for controlling rocking and extension/retraction motions of a furniture member assembly.

BACKGROUND

The statements in this section merely provide background information related to the present disclosure and may not constitute prior art.

Conventionally, reclining articles of furniture (i.e., chairs, sofas, loveseats, and the like) require a mechanism to bias a leg rest assembly in either extended or stowed positions. Known mechanisms commonly include a large number of moving parts that tends to increase the manufacturing time and costs associated with the article of furniture.

Most reclining rocking chairs include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed or retracted) and elevated (i.e., extended or protracted) positions. The drive mechanism is manually-operated and includes a handle which, when rotated by the seat occupant, causes concurrent rotation of a drive rod for extending or retracting the leg rest assembly. Disadvantages of known mechanisms for providing these functions include a large quantity of parts.

As an additional comfort feature, a latching mechanism may also be provided for releasably retaining the chair frame in one or more rearwardly rocked or "tilted" positions on the base assembly following extension of the leg rest assembly towards its extended position. In this manner, normal "rocking" action of the rocking chair is inhibited until the leg rest assembly is returned to its normally "stowed" position. Common furniture member designs use a ratchet and pawl combination to latch the mechanism. Disadvantages of these mechanism designs result as the furniture member rocks when the leg rest is moved between the successive positions, and due to the multiple components required to engage and disengage the mechanisms. A ratcheting noise often accompanies the latching function, and wear of the ratchet and pawl members can lead to a loss of the ratcheting function. An improved mechanism is therefore desirable to eliminate the above disadvantages.

SUMMARY

According to several embodiments of a furniture mechanism with tilt cam for multiple position body tilt of the present disclosure, a furniture mechanism includes a linkage assembly having a pantograph linkage set defining a legrest portion operable to support a user and rotatable between a fully reclined and a fully extended positions. A base frame includes first and second side channels. At least one tilt cam is rotatably connected to the linkage assembly. The tilt cam includes a plurality of cam faces operable to define a plurality of rotation positions of the mechanism by contact of individual ones of the cam faces with the first and second side channels.

According to further embodiments of the present disclosure, a furniture mechanism includes opposed first and second connection plates. First and second support members are each rotatably pinned to one of the first and second connection plates. A base frame includes opposed first and second side channels, and a substantially U-shaped leaf spring interconnected to each of the first and second side channels and connected to each of the first and second support members. The leaf spring permits co-rotation of at least the first and second connection plates and the first and second support members with respect to the base frame. First and second tilt cams are each rotatably fastened to one of the first and second support members. The first and second tilt cams each include a plurality of cam faces defining a plurality of rotation positions of the mechanism by contact of individual ones of the cam faces with the first and second side channels.

According to still further embodiments, a furniture mechanism includes first and second side plates. First and second support members are rotatably pinned to the side plates. First and second pantograph linkage sets are each linked to one of the side plates and each extend from a stowed position to a fully extended position and support a user leg rest. A base frame includes first and second side channels. A U-shaped leaf spring interconnected to the first and second side channels and connected to the support members permits co-rotation of at least the connection plates, the pantograph linkage sets, and the support members with respect to the base frame. First and second tilt cams are rotatably fastened to the support members. The tilt cams each include multiple cam faces which define a plurality of rocking rotation positions of the mechanism by contact of individual cam faces with the side channels.

According to yet still further embodiments, a furniture mechanism includes first and second support members. A base frame includes opposed first and second side channels. A biasing member is connected to each of the first and second side channels and is further connected to each of the first and second support members. The biasing member is operable to permit co-rotation of at least the first and second support members with respect to the base frame. First and second tilt cams are each rotatably fastened to one of the first and second support members. The first and second tilt cams each include at least one cam face operable to define a rotation position of the mechanism by contact of the cam face with the first and second side channels. An occupant center of gravity is positionable forward of a balance point of the biasing member to stabilize the center of gravity between the biasing member and the tilt pads. Contact of the cam face with the first and second side channels defines a locked-up position of the mechanism in the forward/rearward directions. In the locked-up position the tilt cams resist further forward rocking, and the occupant center of gravity being forward of the biasing member balance point allows the biasing member to resist rearward rocking.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
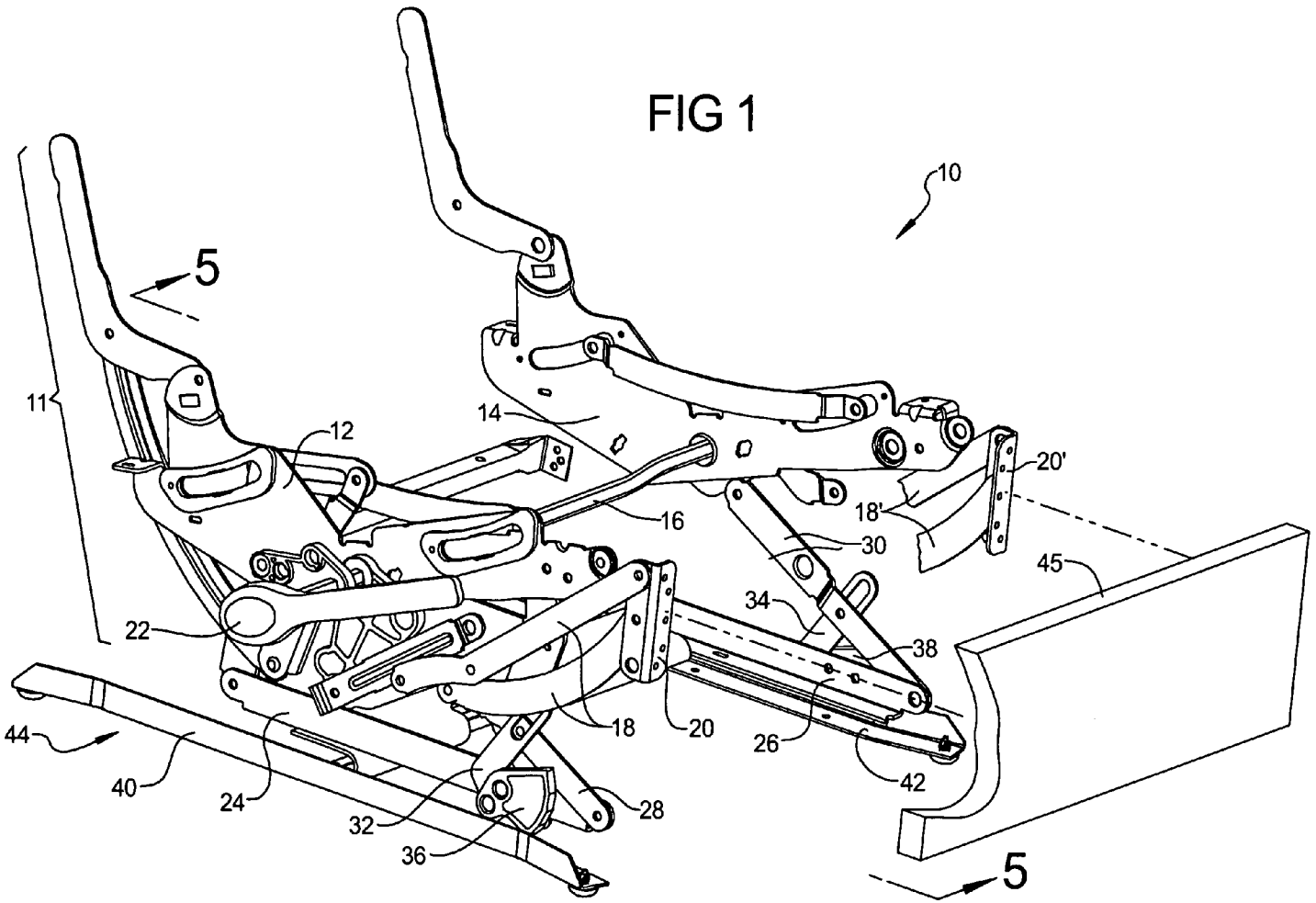
FIG. 1 is a side perspective view of a furniture mechanism with tilt cam for multiple position body tilt of the present disclosure shown in a fully upright, non-extended position.

The following description is merely exemplary in nature and is not intended to limit the present disclosure, application, or uses. It should be understood that throughout the drawings, corresponding reference numerals indicate like or corresponding parts and features. As referred to herein, "front" or "forward" generally corresponds to the direction an occupant faces when seated in the furniture member and "back" or "rearward" generally corresponds to a direction opposite to forward and in general a wall facing direction. "Right hand" and "left hand" also correspond to directions with respect to an occupant when facing forward.

The mechanism 10 of the present disclosure is partially based on and modifies the mechanism disclosed in U.S. Provisional Patent Application No. 60/792,367, filed Apr. 14, 2006, commonly assigned to the assignee of the present disclosure, the subject matter of which is incorporated herein by reference.

According to several embodiments for a furniture mechanism with tilt cam for multiple position tilt of the present disclosure, and referring generally to FIG. 1, a mechanism 10 includes a linkage assembly 11 including a first connection plate 12 and an oppositely positioned, substantially parallel second connection plate 14. Linkage assembly 11 further includes a drive rod 16 rotatably coupled to each of the first and second connection plates 12, 14. Drive rod 16 is linked to a first pantograph linkage set 18, shown connected to first connection plate 12. A second pantograph linkage set 18' is similarly connected to second connection plate 14. A footrest mount plate 20, 20' is connected to each of the pantograph linkage sets 18, 18'. A handle 22 can be provided to manually rotate drive rod 16 to reposition pantograph linkage sets 18, 18' from the stowed position shown to a fully extended position (shown in reference to FIGS. 14 and 16).

Linkage assembly 11 further includes a first support member 24 connectively linked to first connection plate 12, and a second support member 26 similarly connectively linked to second connection plate 14. A first forward support link 28 provides one of the connecting links between first support member 24 and first connection plate 12. Similarly, a second forward support link 30 connects second support member 26 to second connection plate 14. First and second slotted links 32, 34 are each slidably joined to one of the first and second forward support links 28, 30. A first tilt cam 36 is rotatably pinned to first slotted link 32 and a second tilt cam 38 is similarly rotatably pinned to second slotted link 34. First and second tilt cams 36, 38 are also rotatably fastened to the first and second support members 24, 26, respectively.

Linkage assembly 11 is rotatably connected to a base frame 44. First tilt cam 36 is rotatable as mechanism 10 rotates to positively engage a first side channel 40 of a base frame 44. Similarly, second tilt cam 38 is rotatably engageable with a second side channel 42 of base frame 44. A foot rest plate 45 is connected to each of the footrest mount plates 20, 20' and can support the legs of a seat occupant when the pantograph linkage sets 18,18' are extended.

Figure 2:
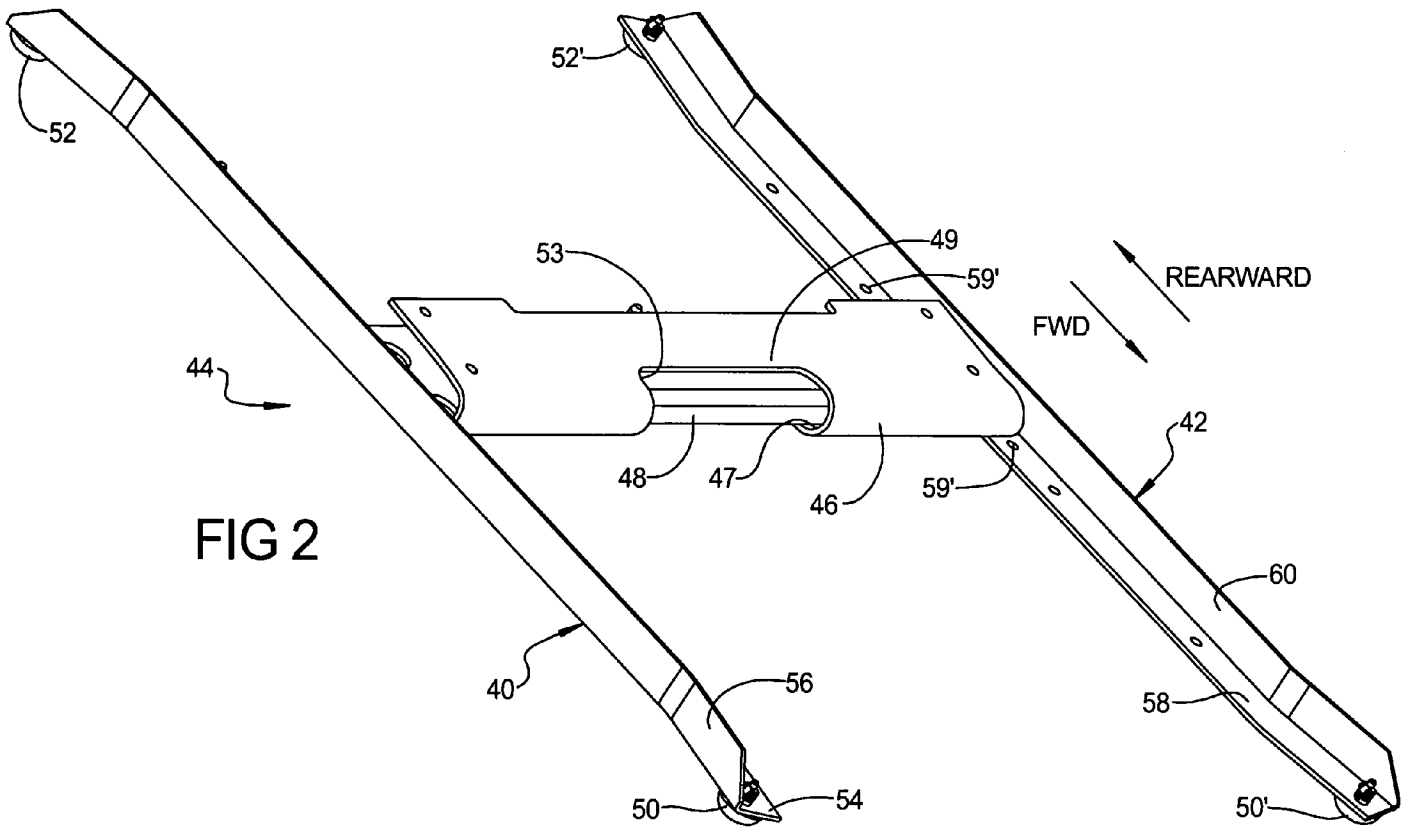
FIG. 2 is a perspective view of a base frame operable to support the mechanism of FIG. 1.

Referring now to FIG. 2, base frame 44 further includes a substantially U-shaped leaf-spring 46 connected such as by fastening to each of the first and second side channels 40, 42 at a first or lower positioned leg 47. A brace member 48 configured as a rectangular metal tube is positioned between the first leg 47 and a second or upper positioned leg 49 of U-shaped leaf-spring 46 and also connected such as by fastening to each of first and second side channels 40, 42. Brace member 48 provides resistance to rotation and increases the stiffness of base frame 44 between first and second side channels 40, 42 to allow the second leg 49 of leaf-spring 46 to rotate with respect to first leg 47, and to permit leaf-spring 46 to be reduced in size compared to a configuration of base frame 44 which does not include brace member 48. Base frame 44 further includes a front support foot 50, 50' connected to each of the first and second side channels 40, 42, and a rear support foot 52, 52' connected to each of the first and second side channels 40, 42, respectively. A cavity 53 created in leaf spring 46 can be included to "tune" the torsional stiffness of leaf spring 46 and is increased or decreased in size accordingly.

First side channel 40 includes each of a first flange 54 and a second flange 56 homogenously connected to first flange 54 and configured substantially perpendicular to first flange 54. First and second flanges 54, 56 define a substantially L-shaped channel and can be formed for example by extruding, stamping, or bending. A first flange 58 and a second flange 60 similarly configured to first and second flanges 54, 56 define substantially L-shaped second side channel 42. Both leaf-spring 46 and brace member 48 are fixedly connected such as by fastening to each of first flange 54 and first flange 58. A plurality of apertures 59, 59' (only apertures 59' are visible in this view) can be provided in both flanges 54, 58 which receive fasteners (shown in reference to FIG. 5) which can co-connect leaf-spring 46 and brace member 48 to first and second side channels 40, 42. Fewer or greater numbers of apertures 59, 59' can also be used. Each of the front and rear support feet 50, 50', 52, 52' is fastened to either first flange 54 or first flange 58, respectively. Either or both of front and rear support feet 50, 50', 52, 52' can be fixed or adjustable height devices.

Figure 3:
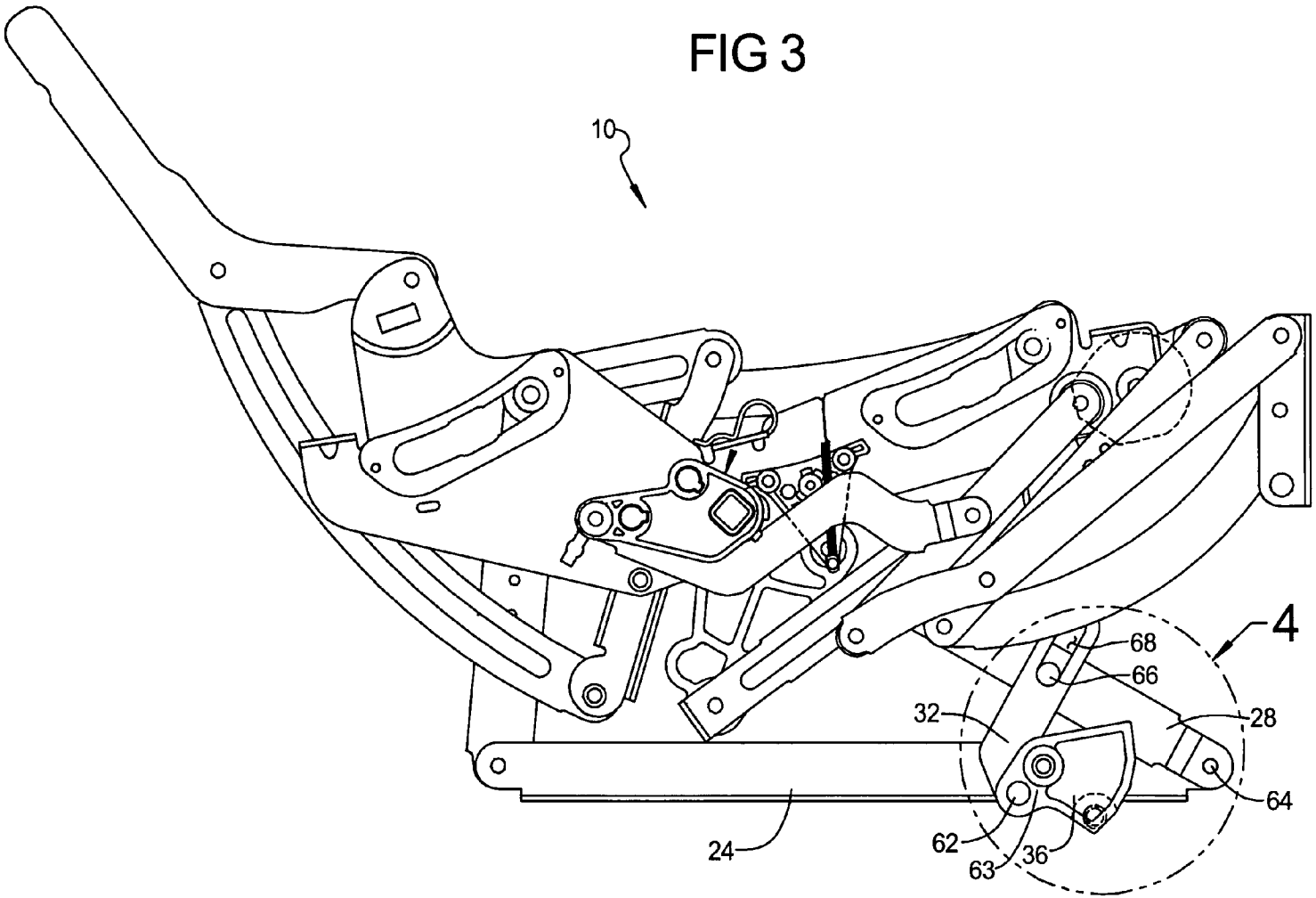
FIG. 3 is a side elevational view of the mechanism of FIG. 1 further showing the tilt cam assembly.

Referring next to FIG. 3, components of a first or a right-hand side of mechanism 10 are shown. Components of the left-hand side of mechanism 10 are similar, and are therefore not further discussed with respect to FIG. 3. First tilt cam 36 is rotatably pinned using a fastener 62 such as a rivet to first slotted link 32, through a reinforced area 63 of first tilt cam 36 and is further rotatably connected using for example a rivet to support member 24 at reinforced area 63 as better described in reference to FIG. 4. A fastener 64 such as a rivet rotatably connects first forward support link 28 to first support member 24 which allows first forward support link 28 to rotate with respect to support member 24. A fastener 66 for example a round-headed tubular body rivet is fixedly connected to first forward support link 28 and extends through a slot 68 created in first slotted link 32. A round head of fastener 66 slideably engages first slotted link 32 and the tubular body slides within slot 68 to permit rotation and displacement of first slotted link 32 and first forward support link 28.

Figure 4:
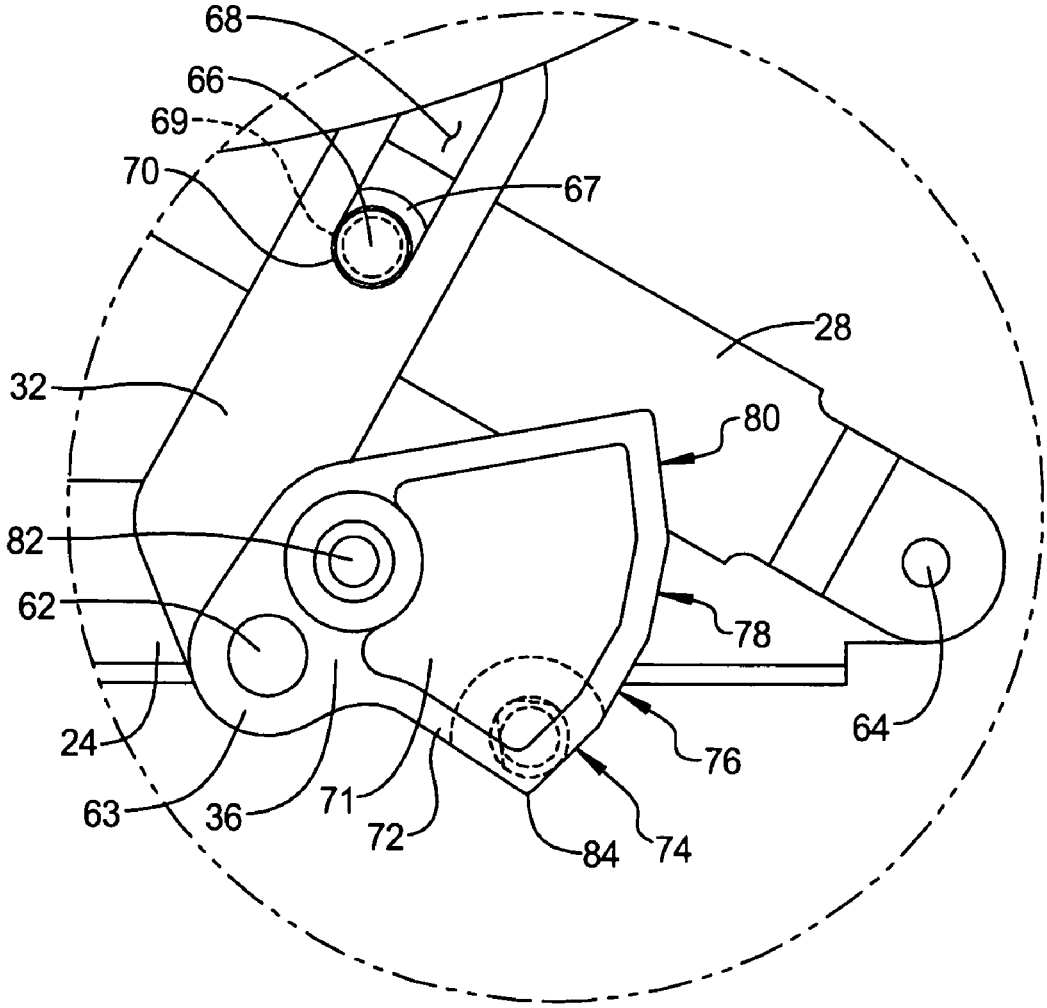
FIG. 4 is an enlarged side elevational view taken at area 4 of FIG. 3.

As best seen in reference to FIG. 4, fastener 66 can further include a flange 67 positioned against a first face of first slotted link 32 (facing away from the viewer as seen in FIG. 4) and a tubular body portion 69 having a diameter adapted to slideably fit within slot 68. A rounded head 70 connected to tubular body portion 69 has a diameter larger than a width of slot 68, which permits fastener 66 to slideably couple first slotted link 32 to first forward support link 28. Second tilt cam 38 is similarly connected to second slotted link 34.

First tilt cam 36 further includes a partial cavity 71 provided to reduce the weight and cost of first tilt cam 36, and a raised outer wall 72 defining a perimeter of first tilt cam 36. A plurality of cam faces are also provided, which include each of a first, second, third, and fourth cam face 74, 76, 78, 80. Each of the cam faces 74, 76, 78, 80 define a substantially flat face, each oriented at an angle with respect to proximate one(s) of the cam faces about raised outer wall 72. A fastener 82 such as a rivet is provided to rotatably couple first tilt cam 36 to first support member 24.

First and second tilt cams 36, 38 can be provided of a polymeric material, injection, cast, or similarly molded to create the shape and multiple cam faces of the tilt cams. A polymeric material for the tilt cams functionally reduces the noise when the tilt cams rotate and engage with members of base frame 44. Material for first and second tilt cams 36, 38 can therefore be a polyamide material, a polypropylene material, or a plurality of other similar polymeric materials that provide wear resistance during use. A cam wall corner 84, positioned proximate to first cam face 74, provides an engagement point for contact with base frame 44 to establish a positive point-of-contact defining a forward-most rotated position of mechanism 10, as will be described in further detail in reference to FIG. 5.

Figure 5:
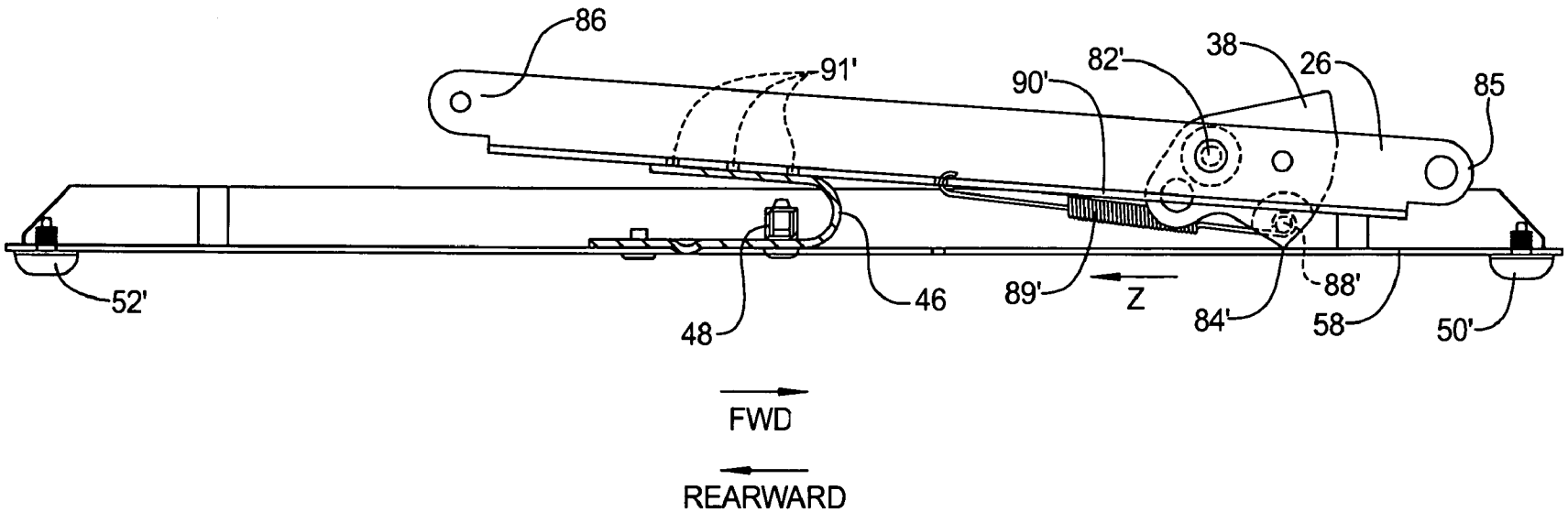
FIG. 5 is a partial cross-sectional side elevational view taken at section 5-5 of FIG. 1, showing a fully forward rotated position of the mechanism.

Referring now generally to FIG. 5, a left-hand side portion of mechanism 10 is shown. The right-hand side portion of mechanism 10 is a mirror-image arrangement. Leaf-spring 46, which as previously described is fastenably connected to each of first and second side channels 40, 42, is fastenably connected to a first flange 90 of first support member 24 (not shown) and to a first flange 90' of second support member 26. First and second support members 24, 26 (as well as first and second connection plates 12, 14, and first and second pantograph linkage sets 18, 18') are therefore rotatable using leaf-spring 46 with respect to base frame 44. Mechanism 10 can be rotated to a fully forward rotated position shown when cam wall corner 84' contacts an upper face of first flange 58. In the fully forward rotated position, a member first end 85 of second support member 26 is positioned generally below a member second end 86. An engagement element 88' is homogenously connected to and extends substantially perpendicularly outward from second tilt cam 38. Engagement element 88' contacts an underside of support member first flange 90' of second support member 26 when cam wall corner 84' contacts first flange 58 of second side channel 42. Contact between flange 90', engagement element 88', and cam wall corner 84' combine to provide a positive stop to define the fully forward rotated position of mechanism 10.

A biasing element 89' such as a tension spring is connected at a first end to engagement element 88' and at a second end which in several embodiments is a looped end through an aperture created in first flange 90' of second support member 26. A biasing element 89 (not visible in FIG. 5) is similarly connected to first tilt cam 36 and first flange 90 of first support member 24. Biasing elements 89, 89' provide a return force in the direction of arrow "Z" to bias the appropriate tilt cam 36, 38 away from the rotated position reached in the fully forward rotated position of mechanism 10. A plurality of apertures 91, 91' (only apertures 91' are visible in FIG. 5) created in each of flanges 90, 90' respectively, receive fasteners (not shown) which allow the position of first and second support members 24, 26 to be moved with respect to leaf-spring 46 in either a forward or rearward direction during or after initial assembly, by selecting different ones of apertures 91, 91'. Apertures 91, 91' therefore permit foreward/rearward balancing of mechanism 10 and the furniture member on base frame 44. In several embodiments, three each of apertures 91, 91' are created with center ones of the apertures providing a first balanced condition.

Figure 6:
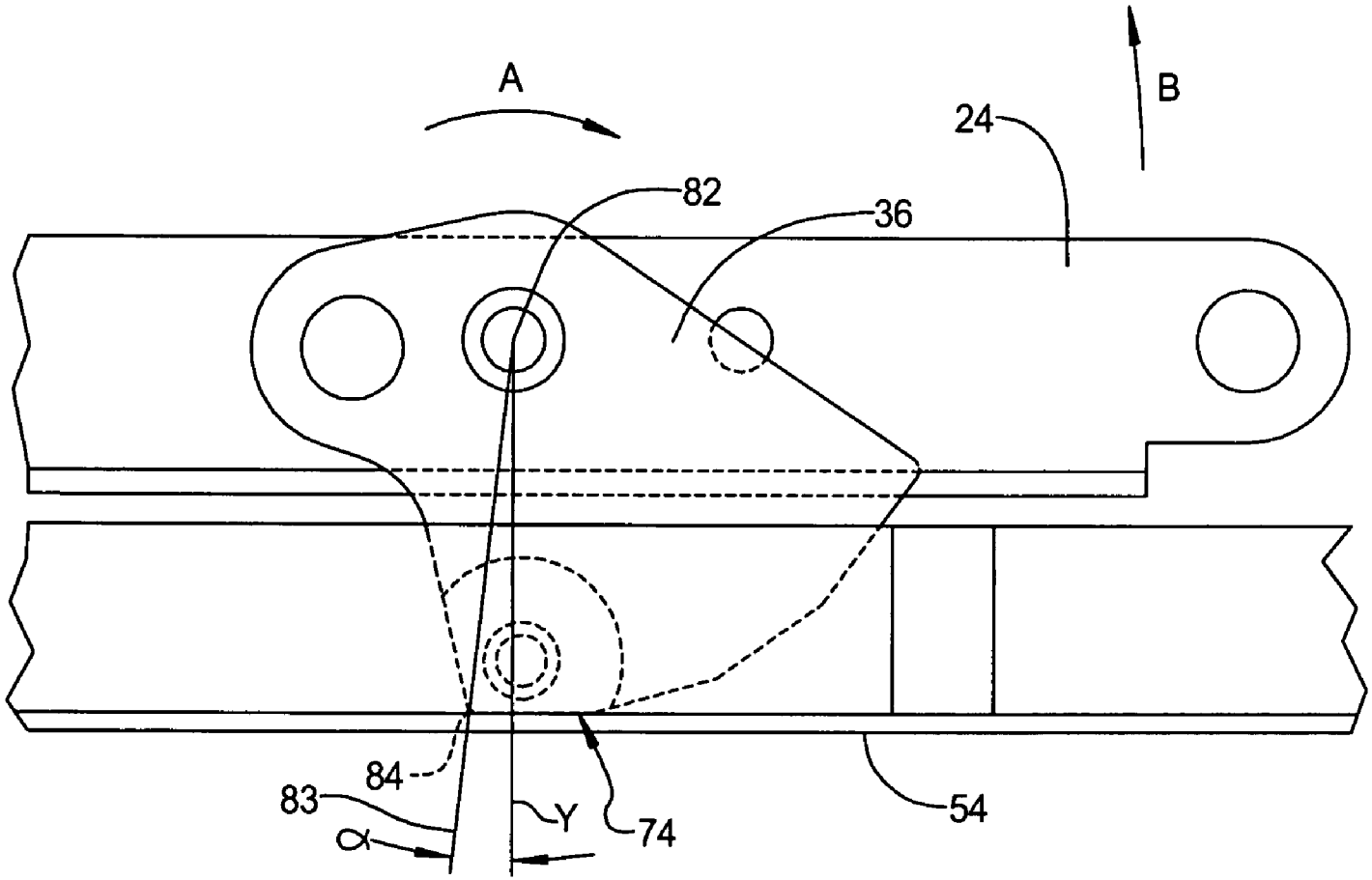
FIG. 6 is a partial cross-sectional side elevational view similar to FIG. 5, showing an intermediate position of the mechanism between the fully forward rotated position and a normally upright position of the mechanism.

Referring now to FIG. 6, when mechanism 10 is rotated away from the fully forward rotated position, first tilt cam 36 rotates about a center axis of fastener 82 defining an arc of rotation "A" until first cam face 74 abuts first flange 54. At the same time, first support member 24 rotates about an arc of rotation "B" as a result of the displacement created by rotation of first tilt cam 36. A positive retention force retains first cam face 74 in contact with first flange 54. The retention force is created by orienting first cam face 74 at an angle less than 90 degrees with respect to a reference line 83 intersecting a cam wall corner 84 and a center axis of fastener 82. Reference line 83 defines an angle $\alpha$ with respect to a vertical axis "Y" taken through the center axis of fastener 82 which is also perpendicular to first flange 54. In several embodiments, angle $\alpha$ is approximately 2 to 5 degrees. Angle $\alpha$ creates an over-center weight load through fastener 82 which must be overcome before the biasing force of biasing element 89, 89' causes the tilt cam (here tilt cam 36) to rotate away from the position shown. The retention force creates a self locking feature when an occupant's weight is applied to tilt cam 36.

Figure 7:
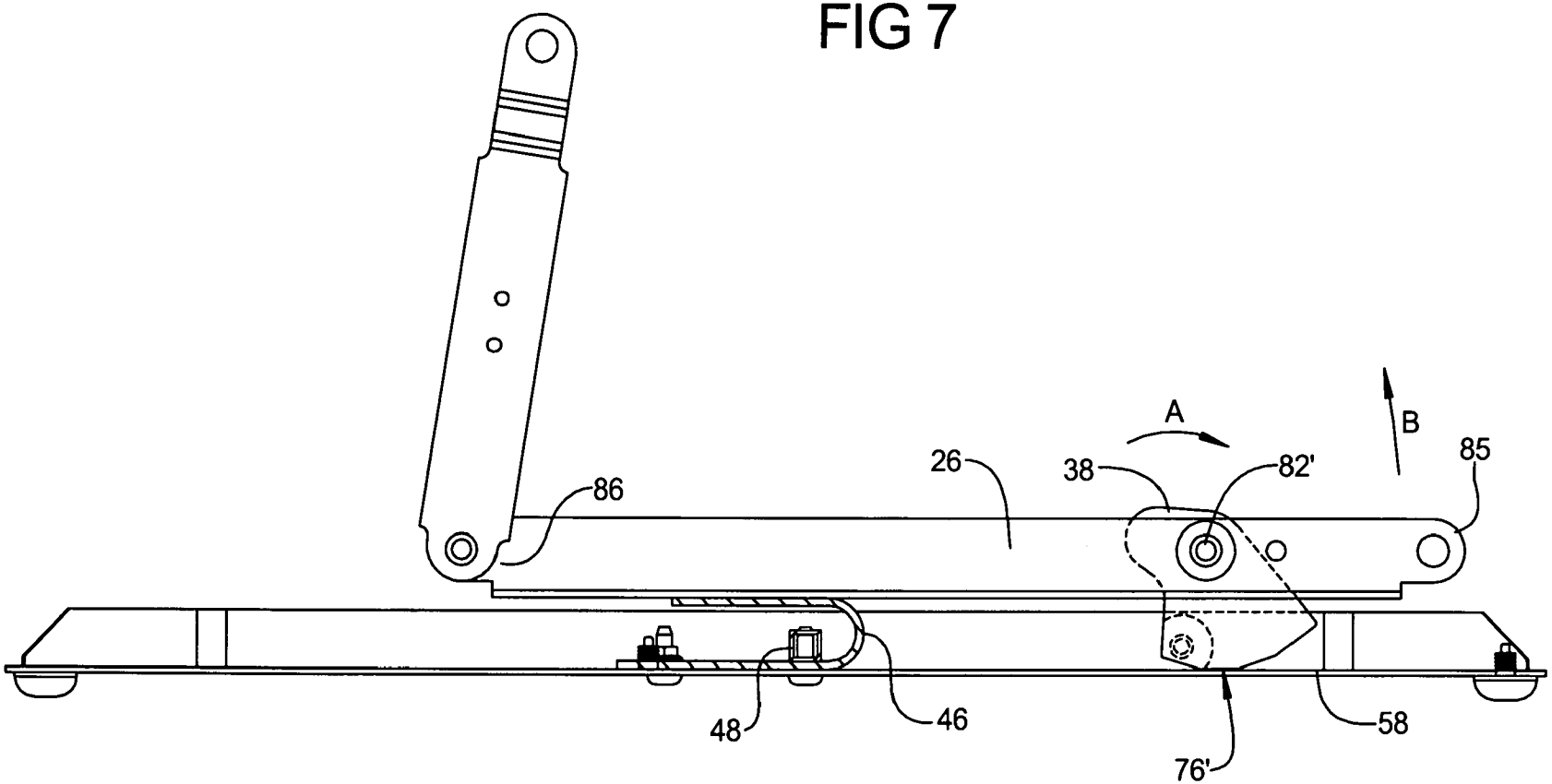
FIG. 7 is a partial cross-sectional side elevational view similar to FIG. 5, showing the normally upright position of the mechanism.

Referring now to FIG. 7, upon continued rotation of mechanism 10, second support member 26 continues to rotate about arc of rotation "B" and second tilt cam 38 continues to rotate about arc of rotation "A" with respect to fastener 82' until second cam face 76' contacts first flange 58. Contact of second cam face 76' with first flange 58 defines the fully upright non-rotated position of mechanism 10.

Figure 8:
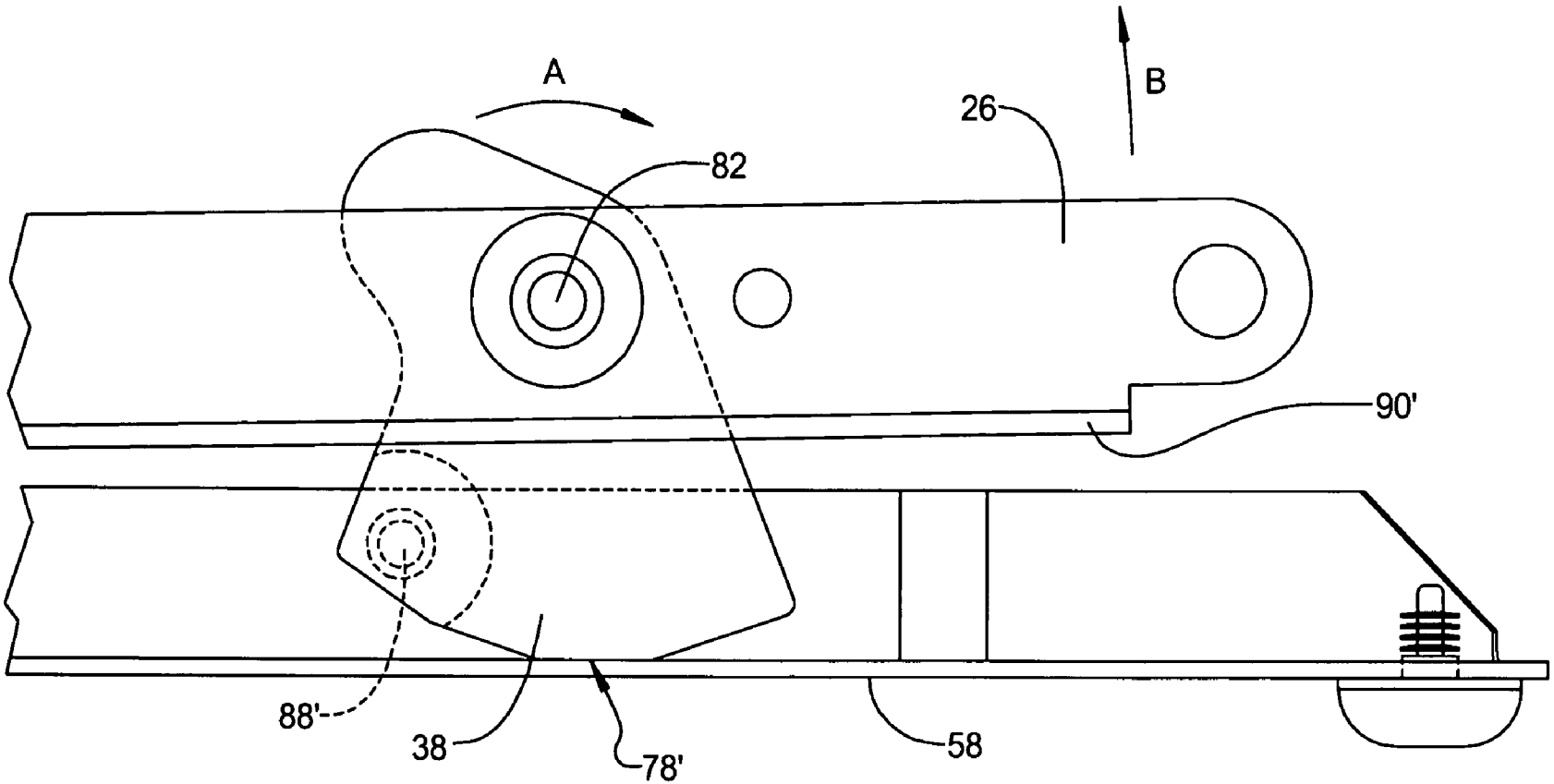
FIG. 8 is a partial cross-sectional side elevational view similar to FIG. 5, showing a second intermediate position of the mechanism between the normally upright position and a fully rearward rotated position of the mechanism.

Referring now to FIG. 8, continued rotation of mechanism 10 about arc of rotation "B" positions third cam face 78' in contact with first flange 58. Second tilt cam 38 continues to rotate about arc of rotation "A" and about fastener 82' until the intermediate position shown in FIG. 8 is reached. In this intermediate position, engagement element 88' is freely positioned between each of first flange 58 and support member flange 90'.

Figure 9:
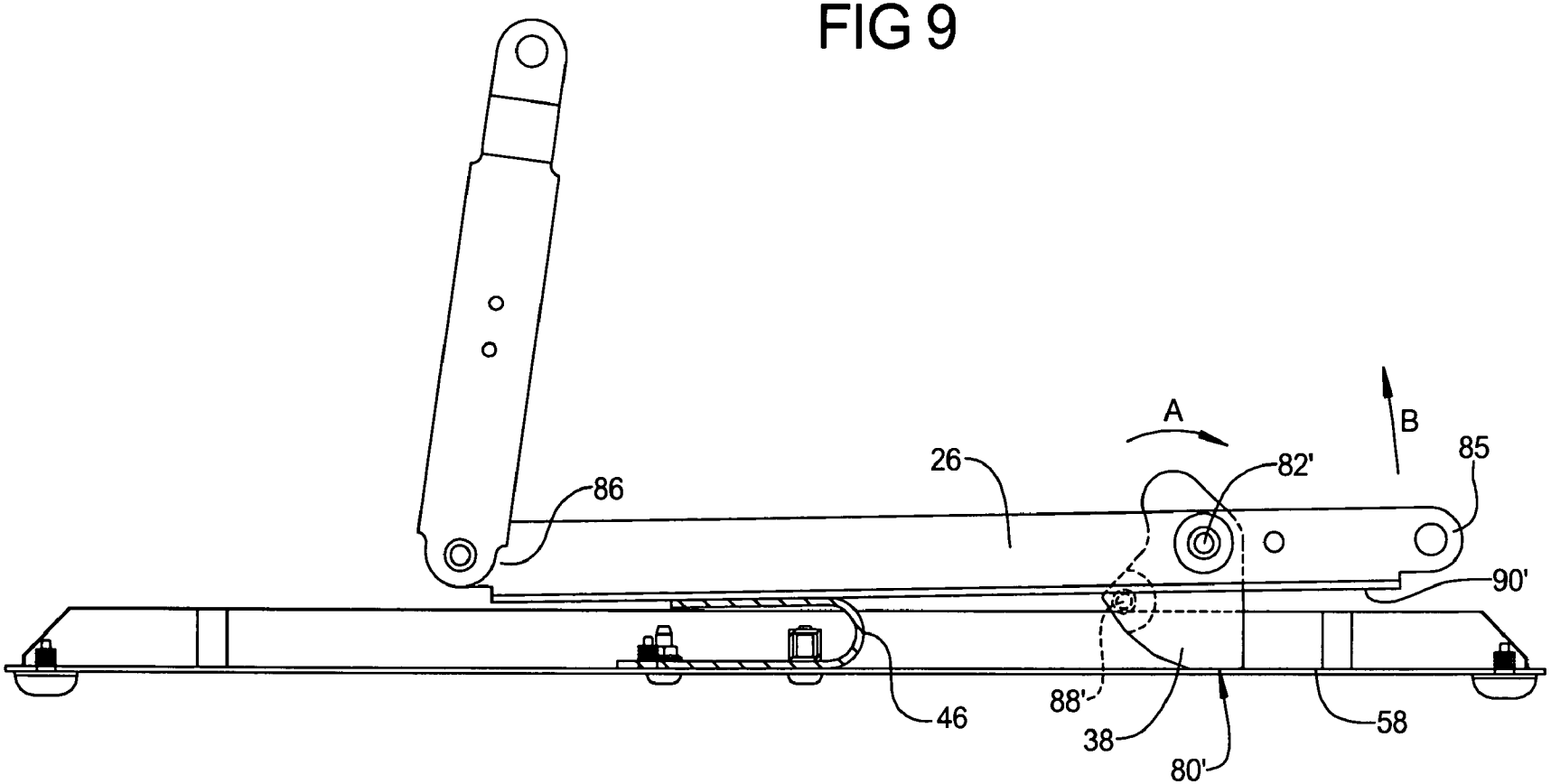
FIG. 9 is a partial cross-sectional side elevational view similar to FIG. 5, showing a fully rearward rotated position of the mechanism.

Referring now to FIG. 9, mechanism 10 can continue to rotate about leaf-spring 46 about arc of rotation "B" and second tilt cam 38 will continue to rotate about arc of rotation "A" about fastener 82' until fourth cam face 80' contacts first flange 58. At this same time, engagement element 88' once again contacts the undersurface of flange 90' to provide a positive stop in the fully rearward rotated position of mechanism 10 shown. In the fully rearward rotated position, member first end 85 of second support member 26 is positioned generally above member second end 86.

Figure 10:
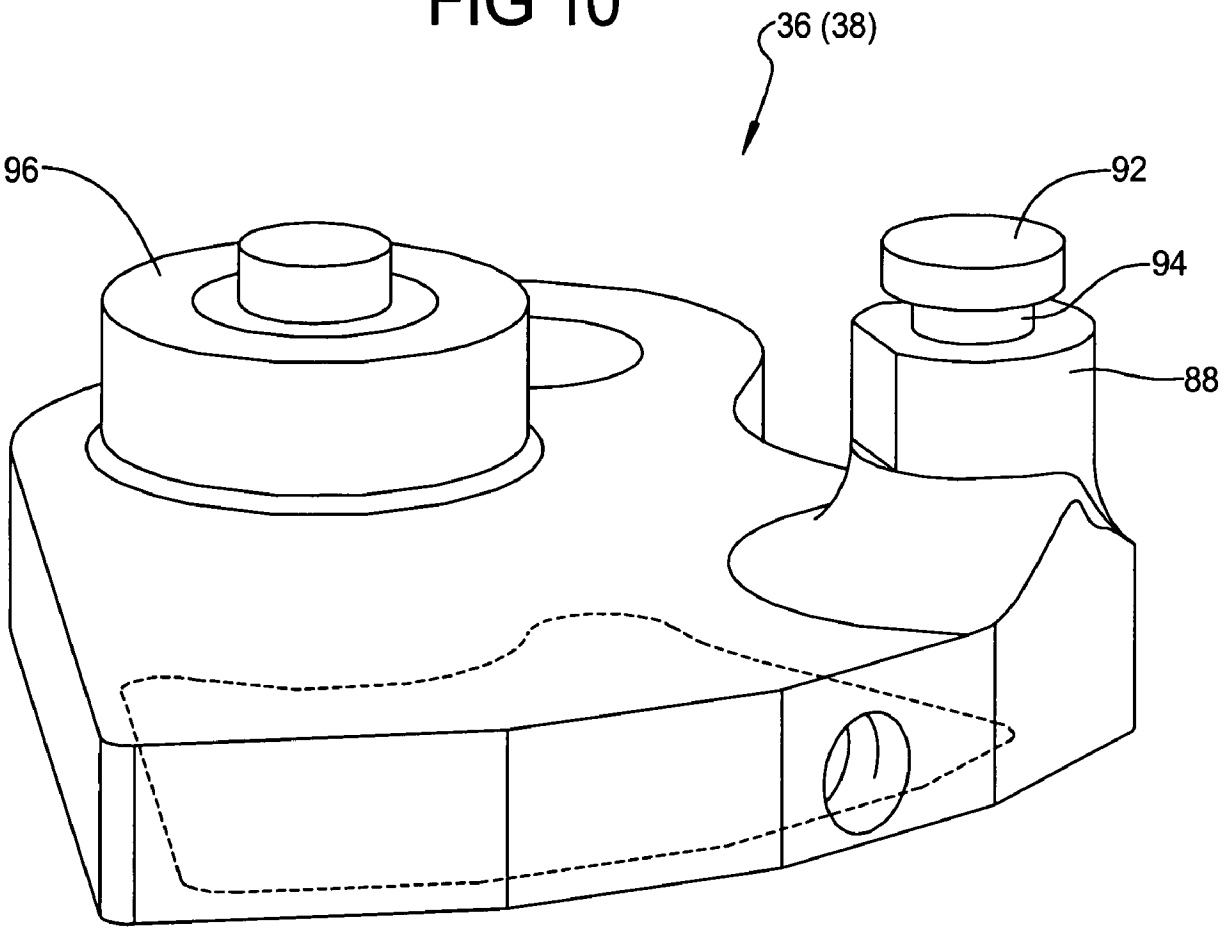
FIG. 10 is a perspective view of a tilt cam of the present disclosure.

Referring generally to FIG. 10, each of the first and second tilt cams 36, 38 further includes a head 92 supported by a neck 94 to engagement elements 88, 88'. Head 92 and neck 94 retain the first end of biasing element 89 or 89' as the tilt cam rotates. A raised shoulder 96 is positioned to receive fastener 82 and provide clearance for rotation of the tilt cam 36, 38 with respect to first or second slotted links 32, 34.

Figure 11:
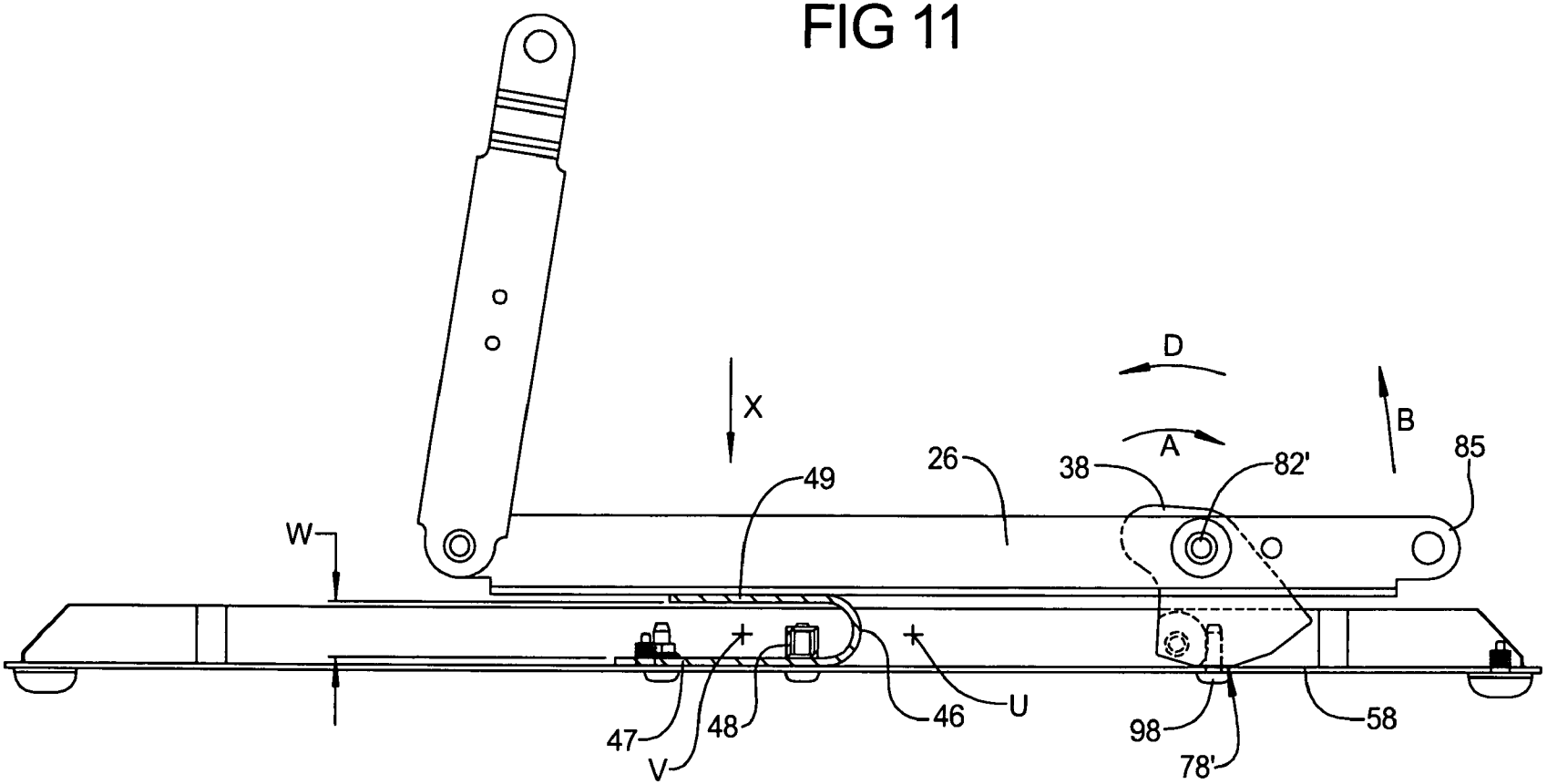
FIG. 11 is a partial cross-sectional side elevational view similar to FIG. 7, showing a locked position of a support member and a deflectable spacing between legs of the leaf spring.

Referring generally to FIG. 11, mechanism 10 can also be used in applications such as in wall proximity furniture members where a rocking motion is not required. The first and second tilt cams 36, 38 can be "locked" to prevent their rotation and subsequent rocking rotation of mechanism 10 by use of a fastener 98 connected through first flange 58 (or first flange 54) and through an aperture (not shown) in second cam face 76' (76). Fastener 98 can be a threaded fastener, a rivet, a bolt, or similar fastener. When fastener 98 is used, rotation of first and second tilt cams 36, 38 is substantially prevented about arc of rotation "A", fixing mechanism 10 in the non-rotated or normally upright position. Some rotation of support members 26 (24) about arc of rotation "B" will still occur with respect to the contact point between fastener 98 and tilt cams 38 (36) as leaf spring 46 deflects.

As further seen in FIG. 11, the use of leaf spring 46 provides an additional deflection capability in either the rotatable or "locked" configurations of mechanism 10. The weight of an occupant on mechanism 10 applied in the direction of arrow "X" can cause a deflection of leaf spring 46 resulting in a decreased spacing "W" between the upper positioned leg 49 and the lower positioned leg 47. The amount of change in spacing "W" can also be tuned or pre-adjusted by changing a spring constant of leaf spring 46. This effect or capability of mechanism 10 to downwardly deflect due to the weight of an occupant is available in any rotated position of tilt cams 36, 38, including the "locked" configuration. This downward deflection provides a softer seat "feel" to the occupant because additional downward deflection in addition to any deflection of the seat support or seat cushions can be obtained.

In further reference to FIG. 11, with or without the use of fastener 98 an occupant center of gravity "U" is positionable forward of a balance point "V" of the leaf-spring 46 to stabilize the center of gravity "U" between the leaf-spring 46 and the tilt pads 36, 38, defining a locked-up position of the mechanism 10 in the forward/rearward directions. In the locked-up position the tilt cams 36, 38 resist further forward rocking, and the occupant center of gravity "U" positioned forward of the leaf spring balance point "V" allows the leaf-spring 46 to also resist rearward rocking.

Figure 12:
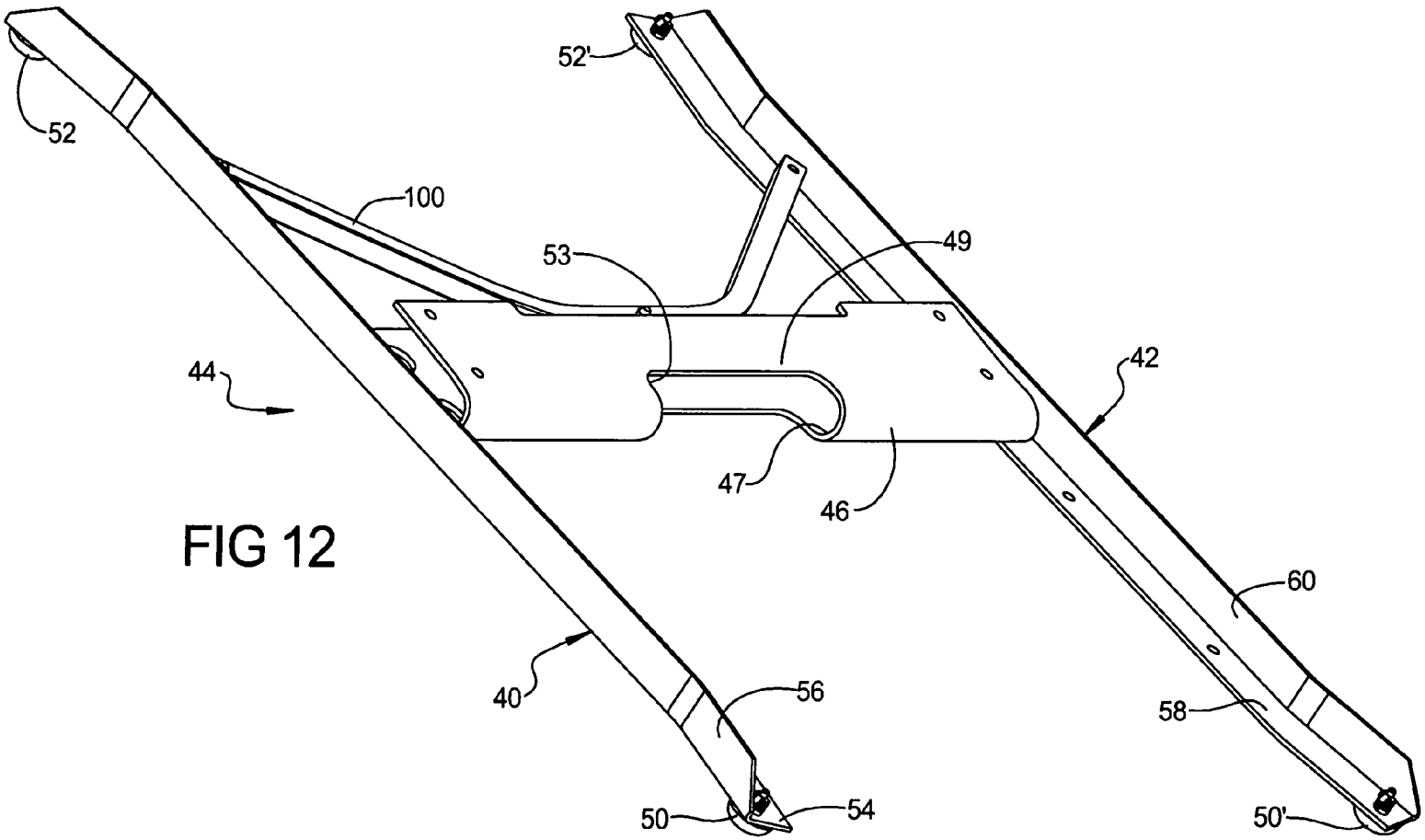
FIG. 12 is a perspective view of the base frame of FIG. 2 having a modified brace member.

Referring now to FIG. 12, in additional embodiments of the present disclosure a modified brace member 100 replaces brace member 48 of FIG. 2. Modified brace member 100 can include a rectangular shaped tube that is bent or formed in one or several locations to change its torsional stiffness compared to brace member 48. In several embodiments, modified brace member 100 defines a substantially V-shaped member. Modified brace member 100 is positioned generally outwardly of leaf spring 46 and is separately connected to first and second side channels 40, 42. To further reduce twisting of base frame 44 and/or leaf spring 46, modified brace member 100 can also be fastened to leaf spring 46, for example at a crotch defined between the bend(s) of modified brace member 100.

Figure 13:
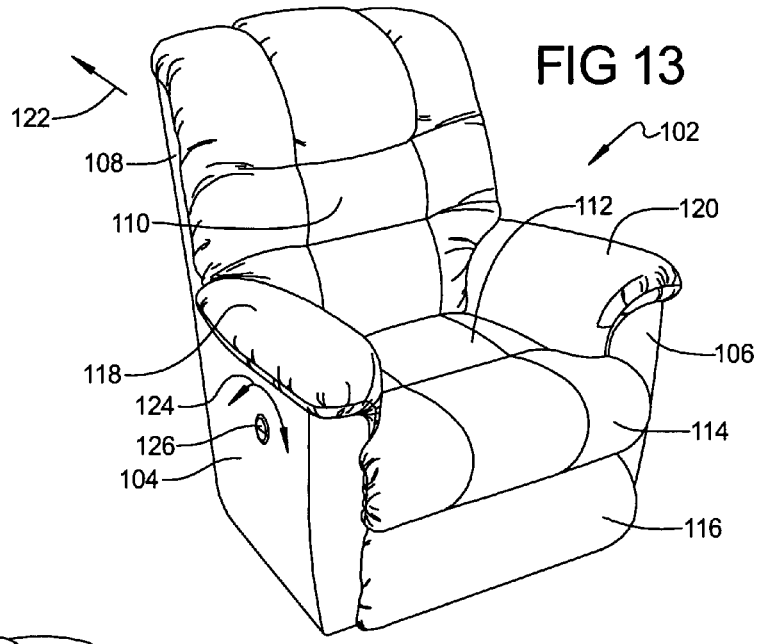
FIG. 13 is a front perspective view of a furniture member having a mechanism of the present disclosure.
Figure 14:
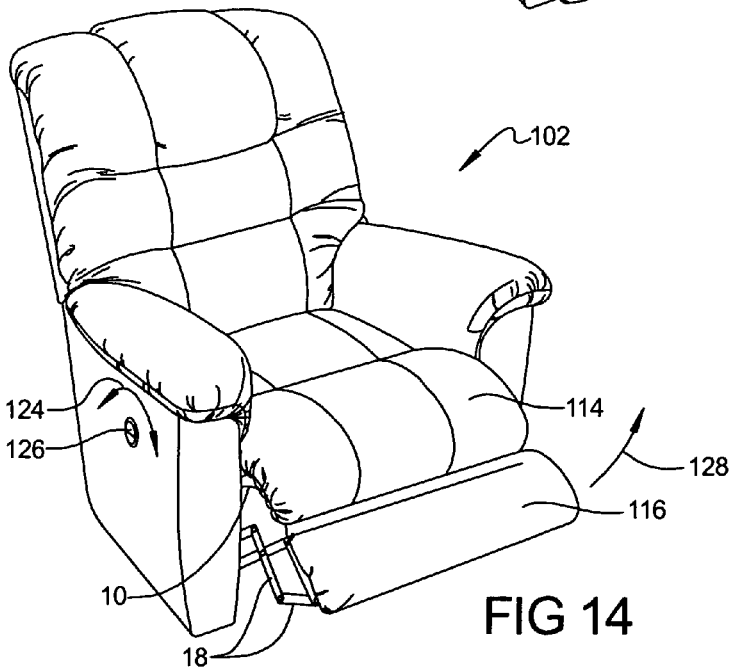
FIG. 14 is a front perspective view of the furniture member of FIG. 13 having a leg rest assembly shown in an extended position.

Referring next to FIGS. 13 and 14, a furniture member 102 depicted as a reclining chair includes first and second sides 104, 106 and an occupant seat back 108 covered with a seat back cushion assembly 110. An occupant support member 112 is suspended between the first and second sides 104, 106 and a padded leg support 114 is also provided. A padded, extendable leg rest 116 is also provided. First and second arm rest pads 118, 120 can be used to cover the upper surfaces of the first and second sides 104, 106 respectively. An occupant's weight generally centered on support member 112 is normally operable to maintain seat back 108 in an upright position. When leg rest 116 is in the stowed position shown, seat back 108 can "pre-recline" or rotate about a seat back arc of rotation 122 independent of the first and second sides 104, 106, support member 112 or leg rest 116 when the occupant leans backward against seat back 108. Seat back 108 can also be returned to the upright position shown and opposite to seat back arc of rotation 122 by the weight of the occupant when the occupant leans forward. In several embodiments, furniture member 102 can further rotate about a furniture member arc of rotation 124.

In the embodiment shown, furniture member 102 is a chair however the present teachings are not limited to chairs. Furniture member 102 can be any of a plurality of furniture members, including, but not limited to single or multiple person furniture members, non-rocking recliners, sofas, motion sofas, sectional members and/or loveseats. In several embodiments, furniture member 102 can include a release latch 126 in place of handle 22 to manually release the leg rest 116 from the stowed position shown.

Referring more specifically now to FIG. 14, release latch 126 is connected to mechanism 10 and when release latch 126 is manually actuated, mechanism 10 directs the repositioning of leg rest 116 from the stowed position (shown in FIG. 1) to a leg rest fully extended position by motion of the leg rest 116 about an extension arc 128. It will be apparent that manual rotation of leg rest 116 in an opposite direction from extension arc 128 will return the leg rest 116 to the stowed position. Mechanism 10 supports leg rest 116. More specifically, mechanism 10 includes first and second pantograph linkage sets 18, 18' (second pantograph linkage set 18' is not visible in this view) which are linked to leg rest 116.

Figure 15:
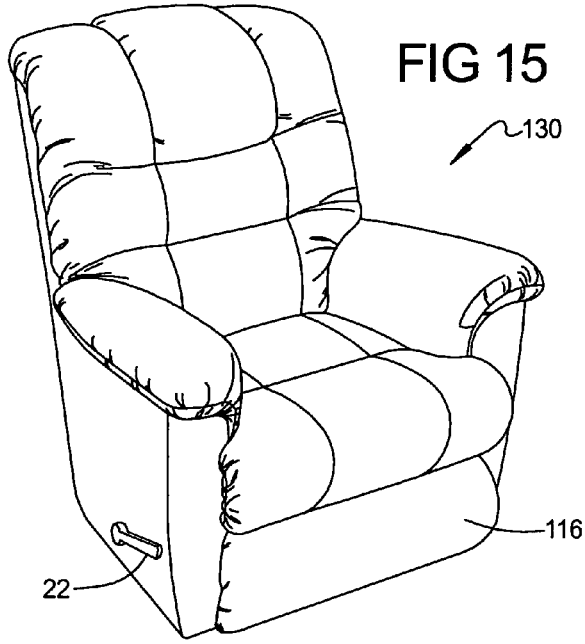
FIG. 15 is a front perspective view similar to FIG. 13 of a furniture member having a handle for operation of the mechanism of the present disclosure.
Figure 16:
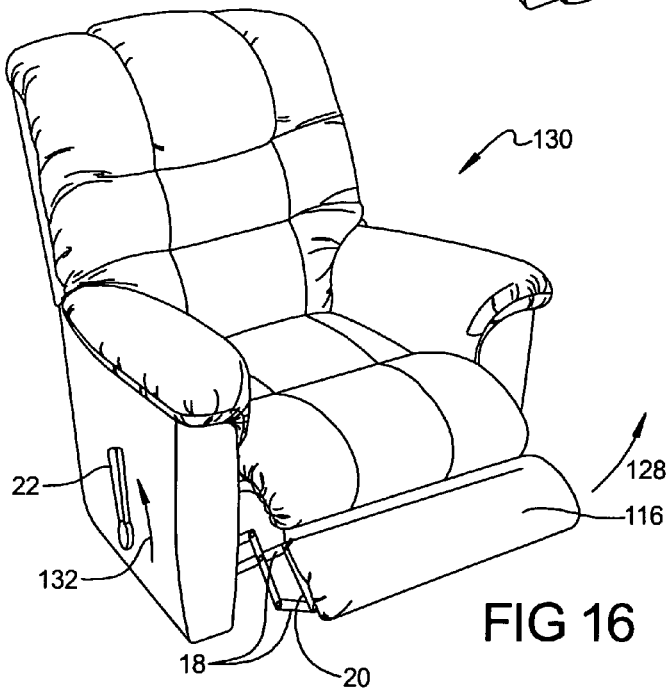
FIG. 16 is a front perspective view of the furniture member of FIG. 15 having a leg rest assembly shown in an extended position.

Referring now to FIGS. 15 and 16, a furniture member 130 depicted as a chair is similar to furniture member 102 of FIG. 13, however handle 22 described in reference to FIG. 1 is used to operate mechanism 10 in place of release latch 126. Handle 20 is manually operated in an arc of rotation 132 to reposition leg rest 116 using first and second pantograph linkage sets 18, 18' (second pantograph linkage set 18' is not visible in this view) and foot rest mount plates 20, 20' (mount plate 20' is not visible in this view) from a leg rest stowed position to a leg rest extended position. It will be apparent that manual rotation of handle 20 in an opposite direction from arc of rotation 132 or rotation of leg rest 116 in an opposite direction from extension arc 128 will return the leg rest 116 to the stowed position.

According to several embodiments, all of the control features and functions of mechanism 10 defining a control apparatus are located entirely within a space envelope of linkage assembly 11. These include but are not limited to drive rod 16, first and second tilt cams 36, 38, and the like. This precludes the need for additional or add-on mechanisms to create a 3-position ottoman control or to provide for multiple position furniture member body tilt.

The first and second tilt cams 36, 38 of the present disclosure replace commonly-used pawl-and-ratchet assemblies of previous rocking/reclining mechanisms and provide several advantages. The tilt cams of the present disclosure eliminate the ratcheting noise that pawi-and-ratchet assemblies commonly produce. The tilt cams of the present disclosure also provide positive stops at each of the fully forward and fully rearward rotated positions, the normally upright or non-rotated position, and at least two intermediate positions of the mechanism. A first intermediate position is between the normally upright and the fully forward rotated positions, and a second intermediate position is between the normally upright and the fully rearward rotated positions. A biasing element connected to the tilt cams provides a return or release force and the substantially flat faces of the tilt cams promote definitive stop positions. A raised embossment or shoulder of each tilt cam also provides two positive stop positions when the tilt cam rotates to two positions engaging the shoulder with one of the first or second support members. The tilt cams of the present disclosure can also be fastened or locked with respect to the side channels of the base frame, permitting the same mechanism 10 to provide for both a rotating and a non-rotating function. The use of a leaf spring of the present disclosure provides for vertical load deflection between the linkage assembly and the base frame.

A further advantage of the mechanism with tilt cams of the present disclosure includes the forward contact position between the tilt cams and the first and second side channels. This forward contact position improves the stability of the furniture member over the single, central support position provided by known ratchet and pawl mechanisms. The tilt cam forward position also allows a center of gravity of the occupant to move further forward on the furniture member without both the furniture member and base tilting forward. As an occupant reclines the mechanism, the occupant's center of gravity travels forward of a balance point (a normal center of bending) of the leaf spring and stabilizes between the leaf spring and the tilt pad(s). In this position, the mechanism is "locked-up" in a fore and aft direction, the tilt pads resisting further forward rocking, and the occupant's center of gravity being forward of the leaf spring balance point allowing the leaf spring to resist rearward rocking, using gravity to help maintain the locked-up position.

The non-rotating position of the mechanism allows the furniture member to be used as a wall proximity member. In addition, the mechanism of the present disclosure supports substantially all of the moving mechanism components except the drive rod at or proximate the connection plates and therefore substantially eliminates moving mechanism components in a space between the connection plates. This allows better access to the mechanism components during assembly and during maintenance.

What is claimed is:

1. A furniture mechanism, comprising:

a linkage assembly having a pantograph linkage set defining a legrest portion for supporting a user which is rotatable between a fully reclined and a fully extended position;

a base frame including first and second side channels; and at least one tilt cam rotatably connected to the linkage assembly, the tilt cam including a plurality of substantially flat cam faces each oriented at an angle with respect to proximate ones of the cam faces, the cam faces defining a plurality of rotation positions of the mechanism by contact of individual ones of the cam faces with one of the first and second side channels to provide a positive stop at each rotated position.

2. The furniture mechanism of claim 1, wherein the at least one tilt cam comprises first and second tilt cams, the first tilt cam positionable to contact the first side channel, and the second tilt cam positionable to contact the second side channel.

3. The furniture mechanism of claim 1, wherein the at least one tilt cam includes a cam wall corner positioned proximate to a first cam face providing an engagement point for contact with the base frame to establish a positive point-of-contact defining a forward-most rotated position of the mechanism.

4. A furniture mechanism, comprising:

a linkage assembly having a pantograph linkage set defining a legrest portion for supporting a user which is rotatable between a fully reclined and a fully extended position;

a base frame including first and second side channels;

first and second tilt cams rotatably connected to the linkage assembly, the first tilt cam positioned to contact the first side channel and the second tilt cam positioned to contact the second side channel, the tilt cams each including a plurality of cam faces defining a plurality of rotation positions of the mechanism by contact of individual ones of the cam faces with one of the first and second side channels; and a biasing element connected to each of the first and second tilt cams at a biasing element first end and connected to one of the first and second side channels at a second end.

5. The furniture mechanism of claim 4, wherein the first and second tilt cams each comprises:

a head connected to a neck, the head and neck both operable to engage the biasing element first end; and a raised shoulder operable to contact a support member of the linkage assembly in each of a fully forward and a fully rearward rotated position of the mechanism.

6. The furniture mechanism of claim 2, wherein each of the first and second tilt cams comprises:

a cam wall corner operable to define a forward rotated position of the mechanism when in contact with one of the first and second side channels;

first, second, and third cam faces operable to define a plurality of rotated positions of the mechanism when in individual contact with one of the side channels; and a fourth cam face operable to define a rearward rotated position of the mechanism when in contact with one of the first and second side channels.

7. A furniture mechanism, comprising:

opposed first and second connection plates;

first and second support members each rotatably pinned to one of the first and second connection plates;

a base frame including opposed first and second side channels;

a linkage assembly connected to the base frame and having a pantograph linkage set defining a legrest portion operating to support a user and rotatable between a fully reclined and a fully extended position; and first and second tilt cams each rotatably fastened to one of the first and second support members, the first and second tilt cams each including a plurality of cam faces defining a plurality of rotation positions of the mechanism by contact of individual ones of the cam faces with the first and second side channels.

8. The furniture mechanism of claim 7, further comprising first and second support links, the first support link rotatably connected between the first connection plate and the first support member, and the second support link rotatably connected between the second connection plate and the second support member.

9. The furniture mechanism of claim 8, further comprising:

first and second slotted links, each including at least a partially enclosed longitudinal slot;

a first fastener fixedly connected to the first support link operable to slidably connect the first slotted link to the first support link by slidable engagement within the longitudinal slot of the first slotted link; and a second fastener fixedly connected to the second support link operable to slidably connect the second slotted link to the second support link by slidable engagement within the longitudinal slot of the second slotted link.

10. The furniture mechanism of claim 9, further comprising:

a third fastener rotatably joining the first tilt cam to the first support member; and a fourth fastener rotatably joining the second tilt cam to the second support member.

11. The furniture mechanism of claim 7, further comprising a drive rod rotatably connected to both the first and second connection plates and operable when rotated to each of extend and retract the pantograph linkage set independently of the rotation positions of the mechanism.

12. The furniture mechanism of claim 7, further comprising a U-shaped leaf spring connected to each of the first and second side channels and connected to each of the first and second support members, the leaf spring permitting co-rotation of at least the first and second connection plates and the first and second support members with respect to the base frame when none of the cam faces are in contact with the first and second side channels.

13. The furniture mechanism of claim 12, further comprising a lower positioned leg and an upper positioned leg of the leaf spring having a spacing therebetween wherein a weight load applied to the mechanism reduces the spacing between the lower and upper positioned legs of the leaf spring.

14. The furniture mechanism of claim 7, further comprising a locked condition of the mechanism having at least one of the first and second tilt cams fastened to one of the first and second side channels.

15. The furniture mechanism of claim 7, further comprising:

a fully forward rotated position of the mechanism having a corner of each of the first and second tilt cams in contact with one of the first and second side channels;

a first biasing element connected to the first tilt cam and the first support member; and a second biasing element connected to the second tilt cam and the second support member;

wherein the first and second biasing elements provide a return force to bias the first and second tilt cams away from the fully forward rotated position of mechanism.

* * * * *